United States Patent [19]

Harandi et al.

[11] Patent Number: 4,968,401

[45] Date of Patent: Nov. 6, 1990

[54] AROMATIZATION REACTOR DESIGN AND PROCESS INTEGRATION

[75] Inventors: Mohsen N. Harandi, Lawrenceville; Hartley Owen, Belle Mead, both of N.J.

[73] Assignee: Mobil Oil Corp., Fairfax, Va.

[21] Appl. No.: 211,611

[22] Filed: Jun. 27, 1988

[51] Int. Cl.[5] ..... C10G 57/02

[52] U.S. Cl. ..... 208/49; 208/147; 208/149; 208/152; 208/160; 208/164; 585/322

[58] Field of Search ..... 208/48 Q, 49, 147, 149, 208/152, 160, 164; 585/322, 324, 330, 407, 418

[56] References Cited

U.S. PATENT DOCUMENTS

| | | | |
|---|---|---|---|
| 2,377,935 | 6/1945 | Gunness | 196/52 |
| 2,386,491 | 10/1945 | McOmie | 196/52 |
| 2,397,352 | 3/1946 | Hemminger | 260/683.3 |
| 2,492,948 | 1/1950 | Berger | 252/417 |
| 2,662,050 | 12/1953 | Moorman et al. | 196/50 |
| 2,971,035 | 2/1961 | Stringer et al. | 585/412 |
| 3,760,024 | 9/1973 | Cattanach | 585/417 |
| 3,835,029 | 9/1974 | Larson | 208/113 |
| 3,894,935 | 7/1975 | Owen | 585/407 |
| 4,172,816 | 10/1979 | Pop et al. | 208/120 |
| 4,180,689 | 12/1979 | Davies et al. | 585/407 |
| 4,374,750 | 2/1983 | Vickers et al. | 252/417 |
| 4,422,925 | 12/1983 | Williams et al. | 208/75 |
| 4,565,897 | 1/1986 | Gane et al. | 585/407 |
| 4,826,586 | 5/1989 | Herbst et al. | 585/322 |

FOREIGN PATENT DOCUMENTS

| | | | |
|---|---|---|---|
| 0202000 | 11/1986 | European Pat. Off. | 585/322 |

*Primary Examiner*—Patrick P. Garvin
*Assistant Examiner*—George R. Fourson
*Attorney, Agent, or Firm*—Alexander J. McKillop; Charles J. Speciale; Robert B. Furr, Jr.

[57] ABSTRACT

A paraffinic feedstream is aromatized in an FCC external catalyst cooler by contacting the paraffinic feedstream with hot regenerated cracking and additive catalysts.

25 Claims, 2 Drawing Sheets

AROMATIZATION REACTOR DESIGN AND PROCESS INTEGRATION

CROSS REFERENCE TO RELATED APPLICATIONS

This application is related to commonly assigned application Ser. No. 144,990 of M. Harandi and H. Owen, now abandoned, which discloses a process for dehydrogenating a lower $C_3$–$C_5$ alkane using hot regenerated catalyst from a fluidized bed catalytic cracking unit.

The present application is also related to a commonly assigned application Ser. No. 144,979, now U.S. Pat. No. 4,840,928, which discloses a process to convert $C_2$–$C_5$ paraffins and olefins to gasoline boiling range aromatics by first heating and dehydrogenating the feedstock in the fluidized catalytic cracking unit regenerator catalyst cooler and then feeding the hot dehydrogenated hydrocarbons stream to a catalytic aromatization reactor.

FIELD OF THE INVENTION

This invention relates to the field of catalytic cracking of hydrocarbons. More particularly, this invention relates to the integration of a process for the catalytic aromatization of paraffins with a fluidized bed catalytic cracking process.

BACKGROUND OF THE INVENTION

During the operation of a fluidized bed catalytic cracking unit (hereinafter FCC), the catalyst accumulates coke. The degree of catalyst coking is related to the process conditions in the reactor riser with more severe cracking conditions increasing the degree of coke deposition. Cracking a higher boiling point feedstock or raising the reactor riser temperature increases cracking severity and consequently increases coke production. Coke blocks access to the pores of the catalyst and must be removed to restore catalytic activity. Removal of coke in the regenerator is exothermic and the heat generated is directly proportional to the amount of coke burned off the catalyst.

Regeneration of the spent catalyst in many applications produces more heat than is required to vaporize and crack the hydrocarbon feedstream entering the reactor riser. Excessively high regenerated catalyst temperatures in the reactor riser are undesirable and decrease gasoline and distillate yields while increasing the production of coke and $C_4$ and lighter hydrocarbons. Therefore, it is advantageous to cool the regenerated catalyst to within an optimum temperature range before it enters the reactor riser.

This invention relates to integrating the dehydrogenation and aromatization of a lower $C_3$–$C_5$ alkane, preferably propane, with the operation of an FCC unit. The dehydrogenation and aromatization of the alkane feedstream is carried out in a fluidized catalyst bed which is divided by a gradual change in catalyst concentration into two reaction zones. The large-pore cracking catalyst is concentrated in the lower section of the reactor and the medium-pore additive catalyst is concentrated in the upper section of the reactor. Specifically, thermal dehydrogenation occurs in the lower section of the reactor in the presence of the large-pore acid zeolite cracking catalyst while the aromatization occurs in the upper section of the reactor in the presence of the medium-pore acid zeolite additive catalyst.

The thermal dehydrogenation of normally liquid hydrocarbons at a temperature in the range from 538° C. to 750° C. (1000° to 1382° F.) by pyrolysis in the presence of steam, is disclosed in U.S. Pat. Nos. 3,835,029 and 4,172,816, inter alia, but there is no suggestion that such a reaction may be used as the basis for a direct heat exchange, to cool regenerated catalyst in an external catalyst cooler for an FCC unit.

FCC regenerators with catalyst coolers are disclosed in U.S. Pat. Nos. 2,377,935; 2,386,491; 2,662,050; 2,492,948; and 4,374,750 inter alia. These previous designs remove heat by indirect heat exchange, typically a shell and tube exchanger. None removes heat by direct heat exchange, for example, by continuously diluting hot regenerated catalyst with cold catalyst, or by blowing a cold gas through the hot catalyst; in particular, none removes heat by functioning as a reactor which supplies heat to an endothermic reaction.

The cooling of hot regenerated catalyst via an endothermic reaction, specifically the catalytic dehydrogenation of butane, was disclosed in U.S. Pat. No. 2,397,352 to Hemminger. Though unrelated to operation of an FCC unit, regeneration of the catalyst was required before it was returned to the dehydrogenation reactor. A catalyst heating chamber was provided for supplying heat to the reaction to compensate for that lost in dehydrogenation, and to preheat the butane feedstock.

SUMMARY OF THE INVENTION

It has been discovered that paraffins, preferably lower paraffins, may be converted to olefins and subsequently to aromatics in an external catalyst cooler/reactor in which hot regenerated large-pore zeolite cracking catalyst from an FCC regenerator dehydrogenates the paraffins and a medium-pore acid zeolite additive catalyst aromatizes the resulting olefins. Because these are endothermic reactions, both catalyst are autogeneously cooled.

The present invention comprises a process for the aromatization of a light paraffinic feedstream and a novel reactor design useful for carrying out the disclosed process. The novel aromatization process uses a large-pore acid zeolite cracking catalyst and a medium-pore acid zeolite additive catalyst to first dehydrogenate the paraffinic stream and then to aromatize the resulting olefinic stream. By integrating this aromatization process with a fluidized catalytic cracking unit (FCC), the endothermic aromatization process may be used to cool hot regenerated catalyst, thereby increasing the throughput of the FCC unit if the FCC unit is regenerator temperature limited. In the FCC unit, a first catalyst regeneration zone is maintained at a pressure from about 270 kPa to 415 kPa (20 psig to 45 psig) and a temperature between 650° C. and 790° C. (1200° F. to 1450° F.). A sufficient amount of oxygen-containing gas is injected into this first catalyst regeneration zone to maintain a dense fluidized bed of cracking and additive catalysts and to regenerate the catalysts. A dehydrogenation zone is maintained in a lower section of a closed catalyst cooler vessel between temperatures of about 620° C. and 740° C. (1100° F. to 1350° F.) and pressures of about 235 kPa to 420 kPa (20 psig to 45 psig). A controlled stream of the regenerated cracking catalyst is withdrawn from the first catalyst regeneration zone and introduced into the dehydrogenation zone located in the lower section of the external catalyst cooler/reactor (ECCR). A feedstream rich in alkanes is introduced into the dehydrogenation zone in an amount sufficient to maintain the regenerated cracking catalyst in a state of fluidization in the lower section of the ECCR. The cracking catalyst is fluidized in a sub-transport regime and is maintained at a temperature between about 620° C. and 740° C. (1100° F. and 1350° F.). The cracking catalyst cools as heat is absorbed by the endothermic dehydrogenation reaction. The flow rate of regenerated cracking catalyst entering the ECCR is controlled such that the volume of regenerated cracking catalyst is sufficient to supply the heat of reaction required for the endothermic dehydrogenation of at least 20% by weight of the alkanes in the alkane-rich feedstream. The cooled cracking catalyst is then transported from the dehydrogenation zone to the catalytic cracking zone of the fluidized catalytic cracking unit where it is optionally mixed with hot regenerated catalyst.

A second catalyst regeneration zone for the regeneration of the medium-pore additive catalyst is maintained at a pressure preferably higher than that of the first catalyst regeneration zone. A sufficient amount of an oxygen-containing regeneration gas is injected into the second catalyst regeneration zone to maintain a dense fluidized bed of the additive catalyst and to regenerate the additive catalyst at moderate temperature between about 370° C. and 540° C. (700° F. and 1000° F.), preferably around 430° C. (800° F.). The moderate regeneration temperature minimizes the catalyst deactivation rate.

The aromatization zone and the dehydrogenation zone are maintained in different sections of the same closed ECCR vessel, thus providing open communication between the dehydrogenation zone and the aromatization zone. A controlled stream of the regenerated additive catalyst is withdrawn from the second regeneration zone and introduced into the aromatization zone to catalyze the aromatization of the olefin-rich product mixture from the dehydrogenation zone. Finally, an aromatic product stream is withdrawn from the aromatization zone.

For the purpose of this disclosure, it is to be understood that the concentrations of large-pore cracking catalyst and small-pore additive catalyst vary inversely through the length of the ECCR vessel. Near the bottom of the vessel, dehydrogenation is the predominant reaction. On the other hand, aromatization is the major reaction near the top of the vessel. While it can be seen that in practice the two zones form a continuum, description of the process is facilitated by designating an upper and lower section by the more prominent reaction occurring in that section. Consequently, a first zone containing the greater concentration of cracking catalyst is named the dehydrogenation zone and a second zone containing the greater concentration of medium-pore additive catalyst is named the aromatization zone.

DETAILED DESCRIPTION

Figure 1:
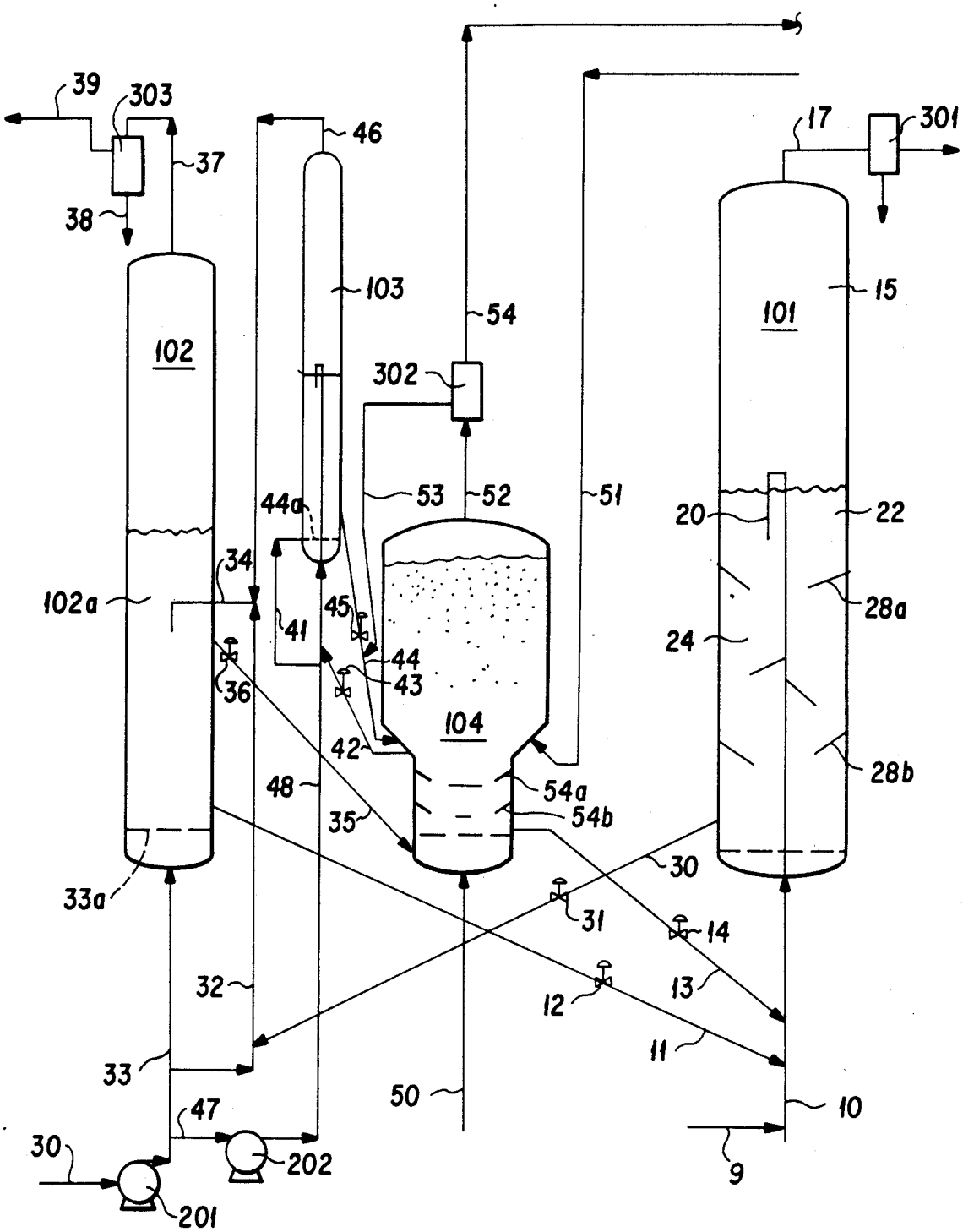
FIG. 1 is a simplified schematic flow diagram of the aromatization process of the present invention.

Cracking catalysts contain active-components which may be zeolitic or non-zeolitic. The non-zeolitic active components are generally amorphous silica-alumina and crystalline silica-alumina. However, the major conventional cracking catalysts presently in use generally comprise a crystalline zeolite (active component) in a suitable matrix. Representative crystalline zeolite active component constituents of cracking include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synthetic mordenite and dealuminized synthetic mordenite, merely to name a few, as well as naturally occurring zeolites, including faujasite, mordenite, and the like. Preferred crystalline zeolites include the synthetic faujasite zeolites X and Y, with particular preference being accorded zeolite Y. Other materials said to be useful as cracking catalysts are the crystalline silicoaluminophosphates of U.S. Pat. No. 4,440,871 and the crystalline metal aluminophosphates of U.S. Pat. No. 4,567,029.

However, the major conventional cracking catalysts presently in use generally comprise a large-pore crystalline silicate zeolite, generally in a suitable matrix component which may or may not itself possess catalytic activity. These zeolites typically possess an average crystallographic pore dimension of about 7.0 Angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synthetic mordenite, dealuminized synthetic mordenite, merely to name a few, as well as naturally occurring zeolites such as chabazite, faujasite, mordenite, and the like. Also useful are the silicon-substituted zeolites described in U.S. Pat. No. 4,503,023.

It is, of course, within the scope of this invention to employ two or more of the foregoing amorphous and/or large-pore crystalline cracking catalysts. Preferred large-pore crystalline silicate zeolite components of the mixed catalyst composition herein include the synthetic faujasite zeolites X and Y with particular preference being accorded zeolites Y, REY, USY and RE-USY.

The shape selective medium-pore crystalline silicate zeolite catalyst is exemplified by ZSM-5, ZSM-11, ZSM-12, ZSM-23, ZSM-35, ZSM-48 and other similar materials. U.S. Pat. No. 3,702,886 describing and claiming ZSM-5 is incorporated herein by reference. Also, U.S. Reissue Pat. No. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12 is more particularly described in U.S. Pat. No. 3,832,499, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,375,573, the entire contents of which are incorporated herein by reference.

The preferred shape selective medium-pore crystalline silicate zeolite components of the mixed catalyst system herein are ZSM-5, ZSM-11, ZSM-12, ZSM-23, ZSM-35, and ZSM-48 with ZSM-5 being particularly preferred.

In general, the aluminosilicate zeolites are effectively employed herein. However, zeolites in which some other framework element which is present in partial or total substitution of aluminum can be advantageous. Illustrative of elements which can be substituted for part or all of the framework aluminum are boron, gallium, titanium and any other trivalent metal which is heavier than aluminum. Specific examples of such catalysts include ZSM-5 and zeolite Beta containing boron, gallium and/or titanium. In lieu of, or in addition to, being incorporated into the zeolite framework these and other catalytically active elements can also be deposited upon the zeolite by any suitable procedure, e.g. impregnation. Gallium-substituted ZSM-5 is a particularly preferred medium-pore additive catalyst and is described in U.S. Pat. Nos. 4,350,835 and 4,686,312, both of which are incorporated by reference as if set forth at length herein.

By appropriate selection of one or more characterizing physical properties, e.g. average particle size and/or density, it is possible to segregate, or separate, particles of first catalyst component from particles of second catalyst component in the closed catalyst cooler to form two reaction zones. Thus, separation of particles of large-pore acid zeolite cracking catalyst from those of medium-pore acid zeolite additive catalyst makes it possible to maintain two reaction zones within the closed catalyst cooler vessel. For example, in accordance with this invention, one or more characterizing physical properties of each catalyst component can be such that the first catalyst component will possess a settling rate $R_1$ and the second catalyst component will possess a settling rate $R_2$, the difference between $R_1$ and $R_2$ being such as to contribute, in conjunction with the reactor vessel mechanical design, to the formation of two reaction zones within the closed catalyst cooler vessel.

A variety of techniques can be used to bring about a differential in the settling rate of the catalyst components. For example, the residency time of catalyst particles in a riser is primarily dependent on two factors: the linear velocity of the fluid stream within the riser which tends to carry the entire catalyst bed/conversion products/unconverted feed up and out of the riser into the separator unit and the opposing force of gravity which tends to keep the slower moving catalyst particles within the riser. Ordinarily, in a mixed catalyst system, both catalyst components will circulate through the system at about the same rate.

Among the techniques which can be used for making one catalyst component more dense than the other is compositing each catalyst with a matrix component of substantially different density. Useful matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g. silica-alumina, silica-magnesia, silica-thoria, silica-alumina-zirconia, etc., can be employed for a still wider spectrum of density values from which one may select a specific predetermined value as desired.

Composite catalyst density, expressed in terms of packed density, may vary within the following ranges. The average packed density of the medium-pore additive catalyst is suitably from about 0.4 to 1.4 gm/cm$^3$, preferably from about 0.6 to 1.2 gm/cm$^3$, and more preferably from about 0.9 to 1.2 gm/cm$^3$. The average packed density of the large-pore cracking catalyst is suitably from about 0.6 to 4.0 gm/cm$^3$, preferably from about 1.0 to 3.0 gm/cm$^3$, and more preferably from about 1.0 to 2.0 gm/cm$^3$.

As previously stated, the relative settling rate of each catalyst component can be selected by varying the average particle size of the catalyst particles. This can be readily accomplished at the time of compositing the catalyst particles with various matrix components. As between two catalyst components of significantly different average particle size, the smaller will tend to remain in the top portion of the bed. The effect is particularly pronounced when the gas velocity at the bottom of the bed is significantly higher than the gas velocity at the top of the bed. Where it is desired to increase the residency time, say, of the large-pore zeolite catalyst particles in the lower section of the closed catalyst cooler over that of the medium-pore zeolite catalyst component, the average particle size of the former will usually be larger than that of the latter. So, for example, the average particle size of the medium-pore zeolite catalyst particles can be made to vary from about 10 microns to about 150 microns, preferably from about 20 to about 80 microns, most preferably between 40 microns and 50 microns, while the average particle size of the large-pore zeolite catalyst particles can be made to vary from about 20 to about 500 microns, preferably from about 50 to about 200 microns, most preferably between 100 and 150 microns.

As will be appreciated by those skilled in the art, the settling rate for a particular catalyst component will result mainly from the interaction of each of the three foregoing factors, i.e. density, average particle size and gas velocity. The factors can be combined in such a way that they each contribute to the desired result. However, a differential settling rate can still be provided even if one of the foregoing factors partially offsets another as would be the case where greater density and smaller average particle size coexist in the same catalyst particle. Regardless of how these factors of particle density and size are established for a particular catalyst component, their combined effect will, of course, be such as to result in a significant differential in settling rates of the components comprising the mixed catalyst system of this invention.

By varying the cross-sectional geometry of the catalyst cooler vessel, it is possible to control the residence time of both the denser, larger and/or more irregularly shaped large-pore cracking catalyst particles in the lower section of the vessel and that of the less dense, smaller, and/or more regularly shaped medium-pore additive catalyst in the upper section of the reactor.

The shape selective medium-pore additive zeolite catalyst can be present in the mixed catalyst system over widely varying levels. For example, the medium-pore additive zeolite catalyst can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

Suitable charge stocks for cracking comprise the hydrocarbons generally and, in particular, petroleum fractions having an initial boiling point range of at least 400° F., a 50% point range of at least 600° F. and an end point range of at least 700° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 750° F. must be carried out under vacuum in order to avoid thermal cracking. The boiling temperatures utilized herein are expressed in terms of convenience of the boiling point corrected to atmospheric pressure.

Referring to the figure, a preheated chargestock such as gas oil (boiling range 310° C. to 650° C. (600° F. to 1200° F.) is introduced into the riser 10 through line 9 near the bottom. The charge is combined with a mixture of hot regenerated cracking and additive catalysts entering the riser through primary regenerated catalyst standpipe 11 which is provided with a flow control valve 12 and secondary regenerated catalyst standpipe 13 which is provided with a flow control valve 14. Because the temperature of the hot regenerated catalyst is in the range from about 650° C. to 790° C. (1200° F. to 1450° F.), a suspension of hydrocarbon vapors at a temperature above about 540° C. (1000° F.) is quickly formed, and flows upward through the riser 10. Catalyst particles and the gas oil form products of conversion are discharged from the top of the riser into one or more cyclone separators (not shown) housed in the upper portion 15 of the vessel. The effluent from riser 10 comprises catalysts particles and hydrocarbon vapors which are lead into the cyclone separators which affect separation of catalysts from the hydrocarbon vapors. Such vapors pass into a plenum chamber (not shown) at the top of vessel 101 and are removed through conduit means 17 for recovery and further processing. Optionally, fines may be recovered from the overhead stream flowing through conduit 17 by passing said stream through a sintered metal filter 301.

Catalyst separated from the vapors in the cyclone separators descends through diplegs 20 (only one is shown) to a fluid bed 22 of catalyst maintained in the lower portion of the vessel 101. The fluid bed 22 lies above a stripping zone 24 into which the catalyst progresses, generally downward, and countercurrent to upflowing steam introduced near the bottom of the vessel 101. Baffles **28*a* and 28*b*** (only two are designated) are provided in the stripping zone to improve stripping efficiency.

Stripped catalyst flows through spent catalyst standpipe 30, provided with flow control valve 31, to regenerator inlet line 32. The spent catalyst in line 30 enters line 32 and is immediately fluidized in a stream of air. This fluidized stream of deactivated catalyst is mixed with an oxygen-rich stream flowing through line 46 and is charged through line 34 into the dense fluid catalyst bed **102*a* of catalyst in the lower section of main regenerator 102. The main regenerator is maintained at a pressure from 270 kPa to 450 kPa (25 psig to 50 psig) and a temperature of from about 650° C. (1200° F.) to 790° C. (1450° F.). Regeneration air is introduced into the bottom of the main regenerator 102 through conduit 33 and distributor 33*a*. Cyclone separators (not shown) separate entrained catalyst particles from flue gas and return the separated catalyst to the dense fluid bed 102*a*. Flue gas flows from the cyclones into a plenum chamber (not shown) at the top of the main regenerator 102 and is removed by conduit 37. Hot regenerated catalyst is returned to the bottom of riser 10 by valved standpipe 11**.

Hot regenerated cracking catalyst flows to the lower section of the external catalyst cooler/reactor (ECCR) 104 through valved conduit 35. An alkane-rich mixture, typically rich in $C_2$–$C_4$ alkanes, enters the bottom of the ECCR 104 through reactor feed line 50. More than 20 wt. % of the alkanes are dehydrogenated upon contact with the hot regenerated cracking catalyst which is between about 650° C. and 790° C. (1200° F. and 1450° F.). Stripping vanes **54*a* and 54*b*** (only two are designated) positioned inside the ECCR near the bottom partially separate the additive catalyst from the cracking catalyst.

The olefin-rich product mixture from the thermal dehydrogenation reaction rises through the ECCR where it is admixed with hot regenerated additive catalyst which flows from additive catalyst regenerator 103 through valved conduit 44 into the middle section of ECCR 104. Upon contact with the hot additive catalyst, the olefinic reactants are converted to a highly aromatic product. Spent additive catalyst from ECCR 104 returns through valved conduit 42 to the additive catalyst regenerator charge line 48.

The most preferred feedstream for the ECCR is a feedstream rich in propane. While the operating temperature of the ECCR depends on the operating temperature of the main regenerator and the additive regenerator, the ECCR operates within a range of temperatures, pressures and space velocities such that the conversion of paraffins to olefins exceeds 20 wt. %, preferably within an operating temperature range from 620° C. (1100° F.) to 740° C. (1350° F.). The preferred ECCR operating pressure ranges from 270 kPa to 420 kPa (25 psig to 45 psig) while the dehydrogenation reaction space velocity ranges from 0.5 $hr^{-1}$ to 500 $hr^{-1}$, preferably between 1 $hr^{-1}$ and 20 $hr^{-1}$. The aromatization reaction space velocity may range from 0.2 $hr^{-1}$ to 200 $hr^{-1}$, preferably from 0.5 $hr^{-1}$ to 5 $hr^{-1}$. The dehydrogenation reaction space velocity is defined as the weight per hour of hydrocarbon feed divided by the weight of the cracking catalyst in the ECCR. The aromatization reaction space velocity is defined as the weight per hour of hydrocarbon feed divided by the weight of the additive catalyst in the ECCR. Heat input to the ECCR is determined by controlling the cracking and additive catalyst withdrawn from the main and additive regenerators, respectively.

Catalyst particles suspended in the product stream may be removed by cyclones internal to the ECCR, sintered metal filters external to the ECCR, or a combination of both.

If a sintered metal filter is used, the gaseous reaction products and the entrained catalyst exit the top of the reactor through conduit 52 and enter sintered metal filter 302. Catalyst flows back to the ECCR through lines 53 and 44 while the product stream flows out of the filter through line 54.

Cyclone separators (not shown) may optionally be positioned in the upper section of the ECCR to separate the aromatic reaction products from the entrained catalyst particles. The separation of gasiform materials from finely divided catalyst particles is discussed in U.S. Pat. No. 4,043,899 to Anderson et al, the disclosure of which is incorporated by reference as if set forth at length herein. A major portion of the catalyst particles is separated from the gaseous reaction products in the cyclone separators and falls back into the catalyst bed below. The gaseous reaction products together with a minor amount of entrained catalyst exit the top of the reactor through conduit 52.

If the cyclones are used alone, line 52 carries the product stream directly into line 54 with no further filtration. However, if a sintered metal filter is used in conjunction with the cyclones, the product stream containing a minor amount of entrained catalyst enters sintered metal filter 302. Catalyst flows back to the ECCR through lines 53 and 44, while the product stream flows out of the sintered metal filter through line 54.

Regeneration air is supplied to the additive catalyst regenerator 103 by secondary regeneration air blower 202. Air enters the regeneration system through line 30, is compressed in primary blower 201 and enters header 33. A slip stream of compressed air flows from header 33 through conduit 47 to secondary air blower 202 where the air is further compressed to a pressure sufficient to charge the air to additive catalyst regenerator 103. A second slip stream of compressed air flows from header 33 through regenerator inlet line 32 to fluidize spent catalyst added from spent catalyst standpipe 30. The balance of compressed air flowing through header 33 is charged to regenerator 102 through air distributor grid **33*a***.

Secondary air blower 202 discharges into additive catalyst regenerator air conduit 48. A controlled amount of air flowing through conduit 48 is diverted directly to the additive catalyst regenerator 103 through conduit 41 and air distributor **41*a*. The balance of the air flowing through conduit 48 fluidizes the spent additive catalyst as the catalyst enters conduit 48 through line 42 at a point in line 48 downstream of line 41. Conduit 48 carries the fluidized additive catalyst into the lower section of additive catalyst regenerator 103 where it discharges near the top of a dense bed of catalyst. As the coked additive catalyst migrates downward through the dense bed, the air flowing upward through the bed burns the coke and reactivates the catalyst. The reactivated additive catalyst entrained in the air flowing out of the additive catalyst regenerator is removed by cyclone separators (not shown) positioned inside regenerator 103 near the top. The combustion products of the additive catalyst regeneration together with excess air in line 46 join with the deactivated cracking catalyst and fresh air in line 32 and are charged to cracking catalyst regenerator 102** near the top of the dense bed of catalyst.

Near the top of cracking catalyst regenerator 102, cyclone separators (not shown) separate the entrained cracking catalyst from the flue gas and excess air. The cracking catalyst is returned to the regenerator and the flue gas and excess air leave the regenerator through conduit 37. If further separation is desired, the flue gas stream in conduit 37 may be charged to a sintered metal filter 303.

Figure 2:
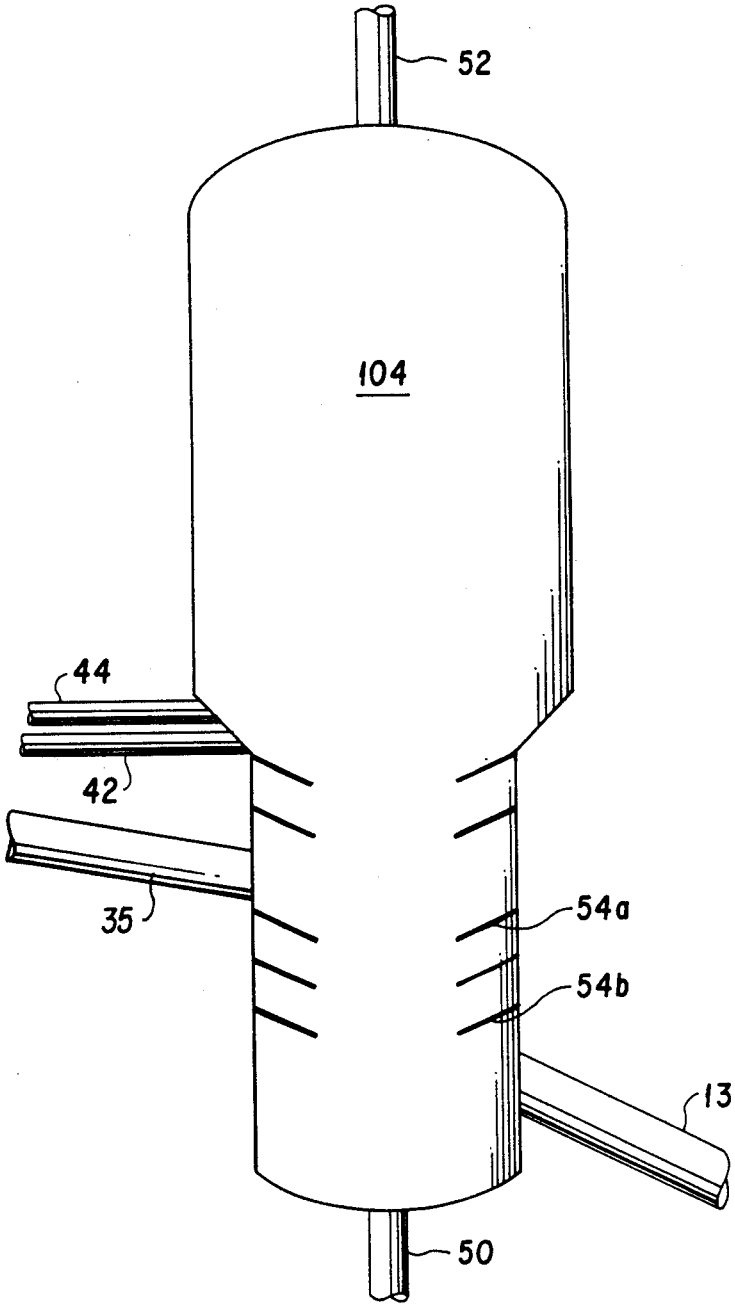
FIG. 2 is a simplified cross-sectional view of the novel reactor of the present invention.

Referring now to FIG. 2, the external catalyst cooler/reactor 104 comprises a cylindrical vessel having a feed inlet nozzle 50 and product outlet nozzle 52. Cracking catalyst inlet nozzle 35 and outlet nozzle 13 extend through the vessel wall in the lower section of the tower. Additive catalyst inlet nozzle 44 and outlet nozzle 42 extend through the wall of the vessel in the upper section of the tower. Vanes 54 and **54*b*** are positioned in the lower section of the vessel to separate the cracking catalyst from the dehydrogenation reaction products and entrained additive catalyst.

By adjusting the relative density and particle size of the large-pore cracking catalyst and the medium-pore additive catalyst, the catalysts may be given different settling rates. Given these different settling rates, the alkane feed rate,and vessel diameter may be determined by one skilled in the art to achieve sub-transport fluidization in the lower section of the vessel.

The vessel may be swaged above the dehydrogenation zone. Hydrogen evolved during the dehygrogenation reaction increases the total gas volume as the reactants flow through the lower section of the vessel. Depending on the relative settling rates of the catalysts and the amount of additional gas evolved in the dehydrogenation reaction, the upper section of the vessel may be smaller or larger than the lower section. The desired diameter may be determined by one skilled in the art to achieve sub-transport fluidization of the catalyst in the upper section of the vessel.

During operation, the concentrations of large-pore cracking catalyst and medium-pore additive catalyst vary inversely through the length of the ECCR vessel. The large-pore cracking catalyst, having a higher settling rate, tends to concentrate in the lower section of the vessel where it forms the dehydrogenation zone. The medium-pore additive catalyst, on the other hand, tends to concentrate in the upper section of the vessel where it forms the aromatization zone.

To attain maximum conversion to aromatics, two factors must be considered by one skilled in the art of fluidized reactor design. First, the catalyst in the ECCR must be maintained in a state of sub-transport fluidization. This is essential to avoid turbulent mixing which would upset the catalyst concentration gradient through the length of the reactor vessel. Second, the temperature of the product stream flowing out of the sintered metal filter 302 through conduit 54 should preferably be maintained between about 535° C. and 600° C. (1000° F. and 1100° F.), more preferably between about 565° C. and 600° C. (1050° F. and 1100° F.). If cyclones are used in place of sintered metal filters, the temperature of the product stream flowing through conduit 52 should be maintained in the same temperature range. As can be seen by one skilled in the art, the feed charge rate and catalyst circulation rates may be controlled such that the desired reactor outlet temperature may be attained without external heating or cooling of the ECCR vessel.

What is claimed is:

1. A process for the aromatization of a feedstream rich in alkanes using a large-pore acid zeolite cracking catalyst and a medium-pore acid zeolite additive catalyst comprising the steps of:

(a) providing both a large-pore acid zeolite cracking catalyst characterized by physical properties to impart a settling rate $R_1$ thereto and a medium-pore zeolite additive catalyst characterized by physical properties to impart a settling rate $R_2$ thereto, wherein said settling rate of said large-pore zeolite cracking catalyst $R_1$ exceeds said settling rate of said medium-pore zeolite additive catalyst $R_2$;

(b) maintaining a first catalyst regeneration zone at a pressure from about 240 kPa to 415 kPa (20 psig to 45 psig) and a temperature between about 650° C. and 790° C. (1200° F. to 1450° F.);

(c) injecting a sufficient amount of an oxygen-containing gas into said first catalyst regeneration zone to maintain a dense fluidized bed of said cracking catalyst and to regenerate said catalyst;

(d) maintaining a dehydrogenation zone in a lower section of a closed catalyst cooler vessel between a temperature of about 590° C. and 740° C. (1100° F. to 1350° F.) and a pressure of about 240 kPa to 420 kPa (20 psig to 45 psig);

(e) withdrawing a stream containing said regenerated cracking catalyst from said first catalyst regeneration zone and introducing it into said dehydrogenation zone;

(f) introducing said alkane-rich feedstream into said dehydrogenation zone in an amount sufficient to maintain said regenerated cracking catalyst in a state of fluidization in said catalyst cooler, said state of fluidization existing in a sub-transport regime while maintained at a temperature between about 590° C. and 740° C. (1100° F. and 1350° F.) and concurrently to cool said cracking catalyst;

(g) regulating the flow rate of said stream of regenerated cracking catalyst such that said stream of regenerated cracking catalyst is sufficient to supply the heat of reaction required for the endothermic dehydrogenation of more than about 20% by weight of the alkanes in the alkane-rich feedstream;

(h) transporting said cooled cracking catalyst resulting from step f from said dehydrogenation zone, said catalyst now at a temperature in the range from about 590° C. to 710° C. (1100° F.–1350° F.), to a catalytic cracking zone, and mixing hot catalyst therein with said cooled catalyst;

(i) maintaining a second catalyst regeneration zone at a pressure higher than that of said first catalyst regeneration zone;

(j) injecting a sufficient amount of an oxygen-containing regeneration gas into said second catalyst regeneration zone to maintain a dense fluidized bed of said additive catalyst and to regenerate said additive catalyst;

(k) maintaining an aromatization zone in an upper section of said closed catalyst cooler at a temperature and pressure below those of said second catalyst regeneration zone;

(l) withdrawing a stream of said regenerated additive catalyst from said second regeneration zone and introducing it into said aromatization zone;

(m) providing open communication between said dehydrogenation zone and said aromatization zone located in said catalyst cooler whereby the resulting products of the dehydrogenation reaction flow freely into the aromatization zone;

(n) withdrawing products from said aromatization zone in a catalyst cooler effluent stream;

(o) withdrawing a stream containing cracking catalyst from said catalytic cracking zone and returning at least a portion of said stream containing cracking catalyst to said first catalyst regeneration zone; and (p) withdrawing a stream containing additive catalyst from said aromatization zone and returning at least a portion of said stream containing additive catalyst to said second catalyst regeneration zone.

2. The process of claim 1 wherein the cracking catalyst is at least one member selected from the group consisting of zeolite X, Y, REY, USY, RE-USY, mordenite, faujasite and mixtures thereof.

3. The process of claim 2 wherein the average particle size and/or density of the large-pore cracking catalyst is larger than the average particle size and/or density of the medium-pore additive catalyst and/or the shape of the large-pore cracking catalyst particles is more irregular than the shape of the medium-pore additive catalyst particles.

4. The process of claim 3 wherein the average particle size of the medium-pore additive catalyst ranges from about 10 to about 150 microns and the average particle size of the large-pore cracking catalyst ranges from about 20 to about 500 microns and/or the average packed density of the medium-pore additive catalyst component ranges from about 0.4 to about 1.4 gm/cm$^3$ and the average packed density of the large-pore cracking catalyst ranges from about 0.6 to about 4.0 gm/cm$^3$.

5. The process of claim 1 wherein the medium-pore additive zeolite has a Constraint Index of between about 1 and about 12.

6. The process of claim 5 wherein the average particle size and/or density of the large-pore cracking catalyst is larger than the average particle size and/or density of the medium-pore additive catalyst and/or the shape of the large-pore cracking catalyst particles is more irregular than the shape of the medium-pore additive catalyst particles.

7. The process of claim 6 wherein the average particle size of the medium-pore additive catalyst ranges from about 20 to about 80 microns and the average particle size of the large-pore cracking catalyst ranges from about 50 to about 200 microns and/or the average packed density of the medium-pore additive catalyst component ranges from about 0.6 to about 1.2 gm/cm$^3$ and the average packed density of the large-pore cracking catalyst ranges from about 1.0 to about 3.0 gm/cm$^3$.

8. The process of claim 1 wherein the medium-pore additive zeolite comprises a zeolite or mixtures of zeolites having the structure of at least one member selected from the group consisting of ZSM-5, ZSM-11, ZSM-12, ZSM-22, ZSM-23, ZSM-35 and ZSM-48.

9. The process of claim 8 wherein the average particle size and/or density of the large-pore cracking catalyst is larger than the average particle size and/or density of the medium-pore additive catalyst and/or the shape of the large-pore cracking catalyst particles is more irregular than the shape of the medium-pore additive catalyst particles.

10. The process of claim 9 wherein the average particle size of the medium-pore additive catalyst ranges from about 40 to about 50 microns and the average particle size of the large-pore cracking catalyst ranges from about 100 to about 150 microns and/or the average packed density of the medium-pore additive catalyst component ranges from about 0.9 to about 1.2 gm/cm$^3$ and the average packed density of the large-pore cracking catalyst ranges from about 1.0 to about 2.0 gm/cm$^3$.

11. The process of claim 1 wherein the medium-pore additive zeolite comprises a zeolite having the structure of ZSM-5.

12. The process of claim 11 wherein the average particle size and/or density of the large-pore cracking catalyst is larger than the average particle size and/or density of the medium-pore additive catalyst and/or the shape of the large-pore cracking catalyst particles is more irregular than the shape of the medium-pore additive catalyst particles.

13. The process of claim 12 wherein the average particle size of the medium-pore additive catalyst ranges from about 10 to about 150 microns and the average particle size of the large-pore cracking catalyst ranges from about 20 to about 500 microns and/or the average packed density of the medium-pore additive catalyst component ranges from about 0.4 to about 1.4 $gm/cm^3$ and the average packed density of the large-pore cracking catalyst ranges from about 0.6 to about 4.0 $gm/cm^3$.

14. The process of claim 1 wherein the medium-pore additive zeolite comprises a zeolite having the structure of Ga-ZSM-5.

15. The process of claim 14 wherein the average particle size and/or density of the large-pore cracking catalyst is larger than the average particle size and/or density of the medium-pore additive catalyst and/or the shape of the large-pore cracking catalyst particles is more irregular than the shape of the medium-pore additive catalyst particles.

16. The process of claim 15 wherein the average particle size of the medium-pore additive catalyst ranges from about 10 to about 150 microns and the average particle size of the large-pore cracking catalyst ranges from about 20 to about 500 microns and/or the average packed density of the medium-pore additive catalyst component ranges from about 0.4 to about 1.4 $gm/cm^3$ and the average packed density of the large-pore cracking catalyst ranges from about 0.6 to about 4.0 $gm/cm^3$.

17. The process of claim 1 wherein the average particle size and/or density of the large-pore cracking catalyst is larger than the average particle size and/or density of the medium-pore additive catalyst and/or the shape of the large-pore cracking catalyst particles is more irregular than the shape of the mediun-pore additive catalyst particles.

18. The process of claim 17 wherein said alkanes are lower alkanes having from 3 to about 5 carbon atoms.

19. The process of claim 18 wherein the space velocity of the dehydrogenation reaction ranges between 1 $hr^{-1}$ and 20 $hr^{-1}$ and the space velocity of the aromatization reaction ranges between 0.5 $hr^{-1}$ and 5 $hr^{-1}$.

20. The process of claim 1 wherein said alkanes have from 2 to about 20 carbon atoms.

21. The process of claim 20 wherein the space velocity of the dehydrogenation reaction ranges between about 0.5 $hr^{-1}$ and 500 $hr^{-1}$ and the space velocity of the aromatization reaction ranges between about 0.2 $hr^{-1}$ and 200 $hr^{-1}$.

22. The process of claim 1 wherein said alkanes are lower alkanes having from 3 to 5 carbon atoms.

23. The process of claim 22 wherein the space velocity of the dehydrogenation reaction ranges between 1 $hr^{-1}$ and 20 $hr^{-1}$ and the space velocity of the aromatization zone ranges between 0.5 $hr^{-1}$ and 5 $hr^{-1}$.

24. The process of claim 23 wherein said feedstream includes a major amount by weight of propane in relation to the total weight of other hydrocarbons.

25. The process of claim 22 wherein said feedstream includes more than 50% by weight of propane in relation to the total weight of other hydrocarbons.

* * * * *

UNITED STATES PATENT AND TRADEMARK OFFICE

CERTIFICATE OF CORRECTION

PATENT NO. : 4,968,401

DATED : November 6, 1990

INVENTOR(S) : Mohsen N. Harandi et al.

It is certified that error appears in the above-identified patent and that said Letters Patent is hereby corrected as shown below:

Col. 14, line 6, "mediun" should read --medium--.

Signed and Sealed this

Nineteenth Day of May, 1992

*Attest:*

DOUGLAS B. COMER

*Attesting Officer*

*Acting Commissioner of Patents and Trademarks*